US009230479B2

(12) United States Patent
Tan et al.

(10) Patent No.: US 9,230,479 B2
(45) Date of Patent: Jan. 5, 2016

(54) PIXEL DRIVING CIRCUIT, DISPLAY DEVICE AND PIXEL DRIVING METHOD

(71) Applicants: BOE TECHNOLOGY GROUP CO., LTD., Beijing (CN); CHENGDU BOE OPTOELECTRONICS TECHNOLOGY CO., LTD., Chengdu (CN)

(72) Inventors: Wen Tan, Beijing (CN); Xiaojing Qi, Beijing (CN)

(73) Assignees: BOE Technology Group Co., Ltd., Beijing (CN); Chengdu BOE Optoelectronics Technology Co., Ltd., Chengdu (CN)

( * ) Notice: Subject to any disclaimer, the term of this patent is extended or adjusted under 35 U.S.C. 154(b) by 0 days.

(21) Appl. No.: 14/362,114

(22) PCT Filed: Dec. 6, 2013

(86) PCT No.: PCT/CN2013/088746

§ 371 (c)(1),
(2) Date: May 30, 2014

(87) PCT Pub. No.: WO2015/014064

PCT Pub. Date: Feb. 5, 2015

(65) Prior Publication Data

US 2015/0302798 A1 Oct. 22, 2015

(30) Foreign Application Priority Data

Jul. 30, 2013 (CN) ..... 2013 1 0326122

(51) Int. Cl.
*G09G 3/32* (2006.01)

(52) U.S. Cl.
CPC ..... *G09G 3/3233* (2013.01); *G09G 3/3208* (2013.01); *G09G 3/3266* (2013.01); (Continued)

(58) Field of Classification Search
CPC ..... G09G 1/00; G09G 3/00; G09G 3/005; G09G 3/3233; G09G 3/34
See application file for complete search history.

(56) References Cited

U.S. PATENT DOCUMENTS

2008/0198102 A1* 8/2008 Yamashita ..... G09G 3/3233 345/76
2009/0243979 A1 10/2009 Kim
2010/0141645 A1 6/2010 Choi et al.

FOREIGN PATENT DOCUMENTS

CN 1517965 A 8/2004
CN 1601594 A 3/2005

(Continued)

OTHER PUBLICATIONS

PCT Notification of Transmittal of the International Search Report and the Written Opinion of the International Searching Authority, or the Declaration for Counterpart PCT Application No. PCT/CN2013/088746, 14 pgs., (Apr. 23, 2014).

(Continued)

*Primary Examiner* — Michael Faragalla
(74) *Attorney, Agent, or Firm* — Blakely, Sokoloff, Taylor & Zafman LLP

(57) ABSTRACT

The present invention provides a pixel driving circuit, a display device and a pixel driving method. In the pixel driving circuit, the control unit is connected with the data line, a first control line, a second control line, a first gate line and a second gate line; the first charging unit and the second charging unit are both connected with the control unit; a first electrode of the light emitting device is connected with the control unit and the second charging unit, and a second electrode of the light emitting device is connected with the second power supply terminal. According to the present invention, by providing two storage capacitors and improving the pre-charging manner, the gate of the driving transistor is provided with the data voltage lower than the operating voltage. The threshold voltage is stored into the first capacitor, thus the threshold voltage compensation is implemented.

12 Claims, 7 Drawing Sheets

(52) U.S. Cl.
CPC ..... *G09G2300/0819* (2013.01); *G09G 2300/0852* (2013.01); *G09G 2300/0861* (2013.01); *G09G 2310/0251* (2013.01); *G09G 2310/0262* (2013.01); *G09G 2320/043* (2013.01); *G09G 2330/021* (2013.01)

(56) References Cited

FOREIGN PATENT DOCUMENTS

| | | | |
|---|---|---|---|
| CN | 1835058 | A | 9/2006 |
| CN | 101739947 | A | 6/2010 |
| CN | 101908316 | A | 12/2010 |
| CN | 102930822 | A | 2/2013 |
| CN | 102982767 | A | 3/2013 |
| CN | 103413520 | A | 11/2013 |
| CN | 203376957 | U | 1/2014 |
| KR | 10-1257930 | B1 | 4/2013 |

OTHER PUBLICATIONS

Office Action for corresponding Chinese Patent Application No. 201310326122.5, 20 pages (including English translation), (Jan. 6, 2015).

* cited by examiner

PIXEL DRIVING CIRCUIT, DISPLAY DEVICE AND PIXEL DRIVING METHOD

CROSS-REFERENCE TO RELATED APPLICATIONS

This patent application is a U.S. National Phase Application under 35 U.S.C. §371 of International Application No. PCT/CN2013/088746, filed Dec. 6, 2013, entitled PIXEL DRIVING CIRCUIT, DISPLAY DEVICE AND PIXEL DRIVING METHOD, which claims priority to Chinese Patent Application No. 201310326122.5, filed Jul. 30, 2013.

FIELD OF THE INVENTION

The present invention relates to the field of display technology, in particular to a pixel driving circuit, a display device and a pixel driving method.

BACKGROUND OF THE INVENTION

AMOLED (Active Matrix Organic Light Emitting Diode) is used more and more widely. The pixel display elements of the AMOLED are Organic Light Emitting Diodes (OLEDs). The driving thin film transistors generates a driving current in a saturation status, and then the driving current drives OLED to emit light, thereby the AMOLED emits light. FIG. 1 shows the schematic structural view of a basic pixel driving circuit in the prior art. The existing basic pixel driving circuit uses a 2T1C circuit comprising two thin film transistors and a storage capacitor, as shown in FIG. 1.

However, because of the poor uniformity in the threshold voltages Vth of the driving transistors DTFT in the conventional low-temperature polysilicon process technology, and the drift in use, when the same data voltage Vdata is input to the driving transistors DTFT, different driving currents will be generated due to the different threshold voltages of the driving transistors DTFT, resulting in poor uniformity of AMOLED luminance.

To overcome above problems, an AMOLED pixel driving circuit with threshold voltage compensation has been proposed by those skilled in the art. FIG. 2 shows the schematic structural view of a pixel driving circuit with threshold voltage compensation in the prior art. FIG. 3 is an equivalent circuit of that shown in FIG. 2 in discharging stage. The circuit shown in FIGS. 2 and 3 is a 6T1C circuit. In a charging stage, the driving transistor DTFT is cut off from high level VDD and low level VSS by controlling the switch transistors, while one terminal of the storage capacitor C is connected with a voltage input terminal, and the other terminal of the storage capacitor C is connected with the data line. An initial voltage Vini is provided by the voltage input terminal, the data voltage Vdata is provided by the data line. The storage capacitor C is charged by both the voltage input terminal and the data line, such that a voltage Vini-Vdata is generated across the storage capacitor. With reference to FIG. 3, in a discharging stage, the driving transistor DTFT is cut off from high level VDD, low level VSS, data voltage and the initial voltage Vini by controlling the switch transistors, while the switch transistor S1 connecting with the gate and the drain of the driving transistor DTFT is kept turned on, such that the storage capacitor C connecting with the gate and the drain of DTFT is discharged through the driving transistor DTFT. When Vg=Vdata+Vth, the driving transistor DTFT is in a sub-threshold ON state, the discharge is over and the voltage across the storage capacitor is Vth, wherein Vg is the gate voltage of the driving transistor. Vdata is the data signal voltage, and Vth is the threshold voltage of the driving transistor DTFT. In a stage of emitting light to display, Vg=Vdata+Vth, Vss=VSS, Vgs=Vdata+Vth, wherein Vg is the gate voltage of the driving transistor DTFT, Vss is the source voltage of the driving transistor, Vgs is the gate-source voltage of the driving transistor DTFT. Since $I=K*(Vgs-Vth)^2$, $I=K*Vdata^2$, wherein I is the driving current in the driving circuit, therefore the driving current is independent of the threshold voltage, and the threshold compensation is achieved.

Above circuit, however, may implement the threshold compensation only when the driving transistor DTFT is an enhancement type transistor. When the driving transistor DTFT is of depletion type, the threshold voltage Vth of a depletion type transistor is negative. In the discharging stage, the driving transistor will stop discharging when Vg=Vdata, wherein Vg is the gate voltage of the driving transistor DTFT; because the voltages of the gate, source and drain of the driving transistor DTFT are equal to Vdata at this time, that is, the source-drain voltage Vsd=0, such that the discharge is over. The voltage across the capacitor is 0 rather than Vth, thus the threshold compensation is unavailable in the AMOLED pixel driving circuit.

SUMMARY OF THE INVENTION

The present invention provides a pixel driving circuit, a display device and a pixel driving method which can implement threshold compensation regardless of the type of the driving transistor.

To achieve above object, the present invention provides a pixel driving circuit comprising: a light emitting device, a driving transistor, a control unit, a first charging unit, a second charging unit, a first power supply terminal and a second power supply terminal. The control unit is connected with the data line, a first control line, a second control line, a first gate line and a second gate line. The first charging unit and the second charging unit are both connected with the control unit, a gate of the driving transistor is connected with the first charging unit, a drain of the driving transistor is connected with the first power supply terminal, a source of the driving transistor is connected with the control unit. A first electrode of the light emitting device is connected with the control unit and the second charging unit, and a second electrode of the light emitting device is connected with the second power supply.

The control unit is used for charging the first charging unit and the second charging unit in turn based on signals on the first control line, the second control line, the first gate line and the second gate line, such that the voltage across the first charging unit is equal to the threshold voltage of the driving transistor and the voltage across the second charging unit is equal to the data voltage provided by the data line.

The first and second charging units are used for providing a driving voltage for the driving transistor under the control of the control unit, the driving voltage is equal to the sum of the threshold voltage of the driving transistor and the data voltage.

The driving transistor is used for driving the light emitting device to emit light.

Optionally, the control unit comprises: a first switch, a second switch, a third switch and a fourth switch.

A control electrode of the first switch is connected to the first control line, a first electrode of the first switch is connected with a second terminal of the first charging unit and a first terminal of the second charging unit, a second electrode of the first switch is connected with a source of the driving transistor and a first electrode of the fourth switch.

A control electrode of the second switch is connected to the first gate line, a first electrode of the second switch is connected with the data line, a second electrode of the second switch is connected with the first terminal of the first charging unit and the gate of the driving transistor.

A control electrode of the third switch is connected to the second gate line, a first electrode of the third switch is connected with the data line, a second electrode of the third switch is connected with the second terminal of the first charging unit, the first terminal of the second charging unit and the first electrode of the first switch.

A control electrode of the fourth switch is connected to the second control line, a first electrode of the fourth switch is connected with the source of the driving transistor, the second electrode of the fourth switch is connected with the second terminal of the second charging unit and a first electrode of the light emitting device.

Optionally, the pixel driving circuit further comprises: a fifth switch, a control electrode of the fifth switch is connected to the first control line, a first electrode of the fifth switch is connected with the second electrode of the fourth switch and the first electrode of the light emitting device, a second electrode of the fifth switch is connected with the second electrode of the light emitting device and the second power supply terminal.

Optionally, the first power supply terminal provides an operating voltage, the second power supply terminal provides a reference voltage. The first electrode of the light emitting device is a positive electrode, and the second electrode of the light emitting device is a negative electrode.

Optionally, the driving transistor, the first switch, the second switch, the third switch, the fourth switch and the fifth switch are N type thin film transistors.

Optionally, the first power supply terminal provides a reference voltage, the second power supply terminal provides an operating voltage. The first electrode of the light emitting device is a negative electrode, and the second electrode of the light emitting device is a positive electrode.

Optionally, the driving transistor, the first switch, the second switch, the third switch, the fourth switch and the fifth switch are P type thin film transistors.

Optionally, the first gate line and the second gate line are enabled sequentially, and the first gate line leads the second gate line.

Optionally, the first control line and the first gate line are enabled simultaneously, and the first control line keep enabled until the second gate line is disabled. The second control line is disabled within the ON period of the first gate line, and is enabled when the first control line is disabled.

To achieve the above object, the present invention provides a display device comprising: an adjustment unit, a data line driving unit, a gate line driving unit, a data line, gate lines, the first control line, the second control line and a plurality of pixel driving circuit. The adjustment unit is used for adjusting the first and second control lines, the data line driving unit is used for driving the date line, the gate line driving unit is used for driving the gate lines in sequence.

Said pixel driving circuit may be any one of above pixel driving circuit, each pixel driving circuit is connected with two adjacent gate lines among the plurality of gate lines.

To achieve the above object, the present invention provides a pixel driving method based on the pixel driving circuit comprising: a light emitting device, a driving transistor, a control unit, a first charging unit, a second charging unit, a first power supply terminal and a second power supply terminal; the control unit is connected with a data line, a first control line, a second control line, a first gate line and a second gate line; the first charging unit and the second charging unit are both connected with the control unit, a gate of the driving transistor is connected with the first charging unit, a drain of the driving transistor is connected with the first power supply terminal, a source of the driving transistor is connected with the control unit, a first electrode of the light emitting device is connected with the control unit and the second charging unit, and a second electrode of the light emitting device is connected with the second power supply; the pixel driving method comprises the following steps:

the control unit charges the first charging unit based on signals on the first control line, the second control line, the first gate line and the second gate line, such that the voltage across the first charging unit is equal to the threshold voltage of the driving transistor;

the control unit charges the second charging unit based on signals on the first control line, the second control line, the first gate line and the second gate line, such that the voltage across the second charging unit is equal to the data voltage provided by the data line;

the first and second charging units provide a driving voltage for the driving transistor in a predetermined period under the control of the control unit, the driving voltage is equal to the sum of the threshold voltage of the driving transistor and the data voltage;

the driving transistor drives the light emitting device to emit light.

By providing two storage capacitors and improving the pre-charging manner, the present invention sets the gate of the driving transistor to a data voltage between an operating voltage (high level) and a reference voltage (low level). During discharging through the driving transistor, the driving transistor changes from ON state into a sub-threshold OFF state before the source-drain voltage of the driving transistor becomes zero. The threshold voltage is stored into the storage capacitor, thus the compensation for the threshold voltage is implemented regardless of type of the driving transistor.

DETAILED DESCRIPTION OF THE EMBODIMENTS

For persons skilled in the art to understand the solutions of the present invention better, the pixel driving circuit, the display device and the pixel driving method according to the present invention will be described in detail with reference to the accompanied figures.

First Embodiment

Figure 1:
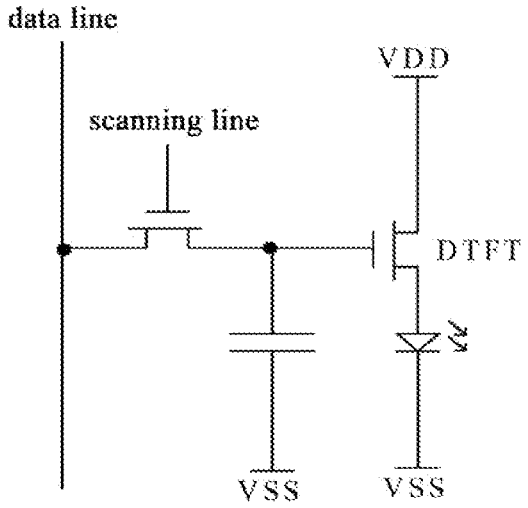
FIG. 1 is a schematic structural view of a basic pixel driving circuit in the prior art.
Figure 2:
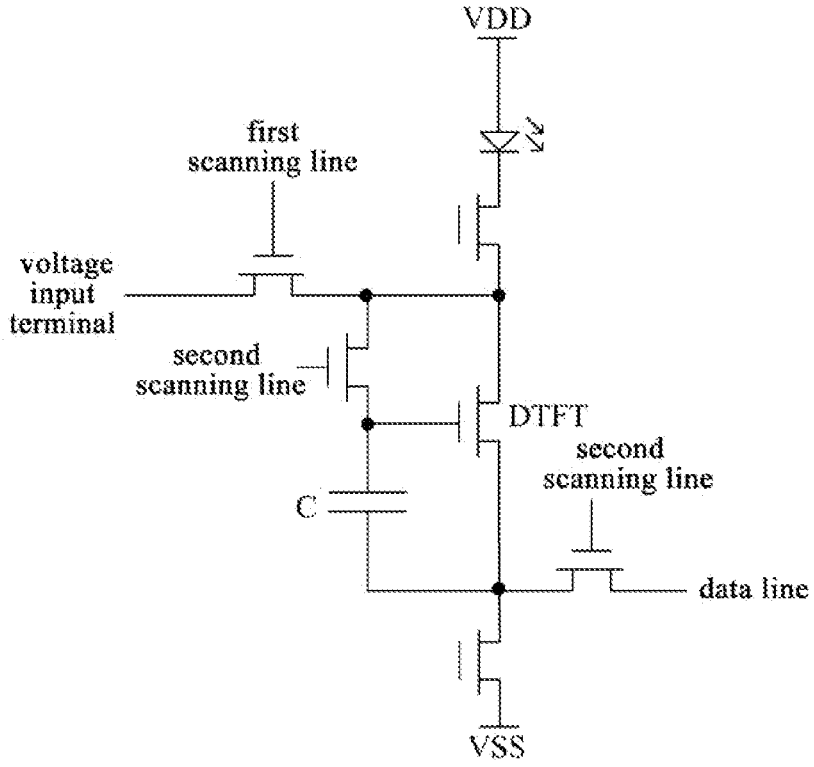
FIG. 2 is a schematic structural view of a pixel driving circuit with compensation for the threshold voltage in the prior art.
Figure 3:
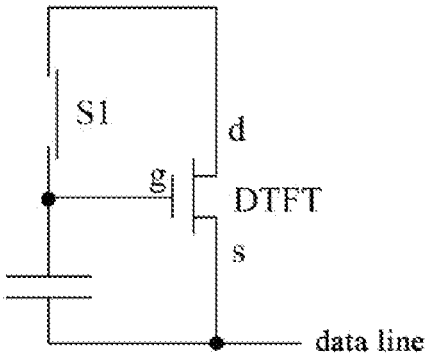
FIG. 3 is a schematic structural view of an equivalent circuit of the circuit shown in FIG. 2 in discharging stage.
Figure 4:
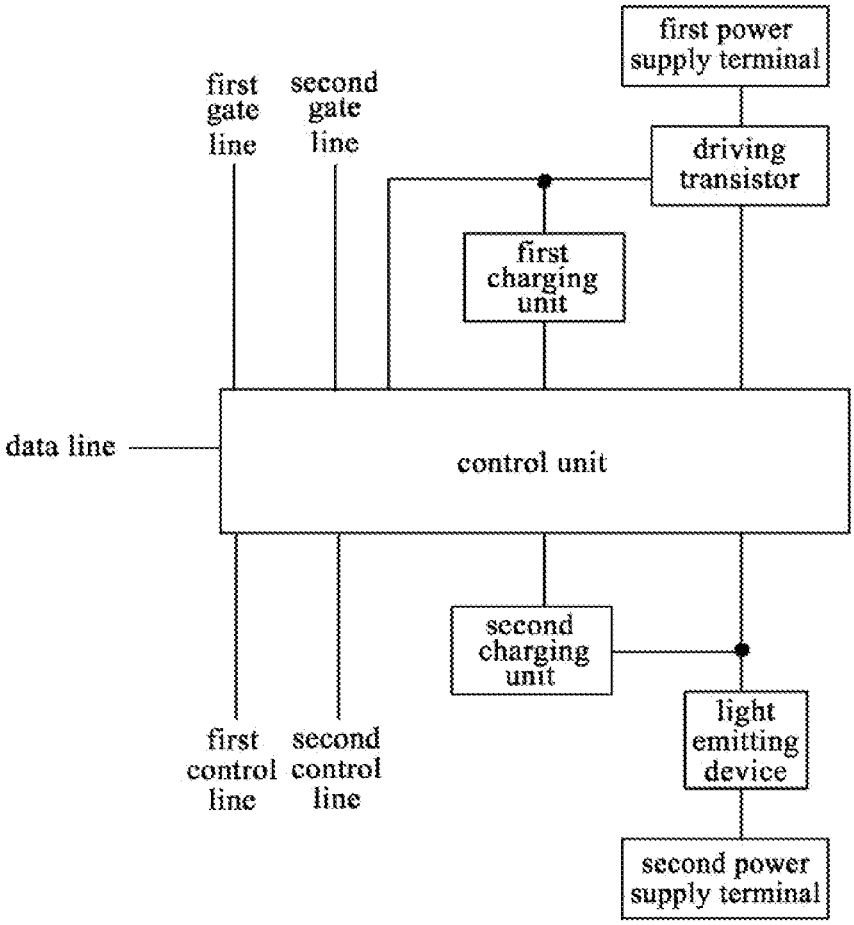
FIG. 4 is a schematic structural view of a pixel driving circuit according to the first embodiment of the present invention.

FIG. 4 is a schematic structural view of a pixel driving circuit according to the first embodiment of the present invention. As shown in FIG. 4, the pixel driving circuit comprises: a light emitting device, a driving transistor, a control unit, a first charging unit, a second charging unit, a first power supply terminal and a second power supply terminal. The control unit is connected with a data line, a first control line, a second control line, a first gate line and a second gate line. The first charging unit and the second charging unit are both connected with the control unit, a gate of the driving transistor is connected with the first charging unit, a drain of the driving transistor is connected with the first power supply terminal, a source of the driving transistor is connected with the control unit. A first electrode of the light emitting device is connected with the control unit and the second charging unit, and a second electrode of the light emitting device is connected with the second power supply.

The control unit charges the first charging unit and the second charging unit in turn based on signals on the first control line, the second control line, the first gate line and the second gate line, such that the voltage across the first charging unit is equal to the threshold voltage of the driving transistor and the voltage across the second charging unit is equal to the data voltage provided by the data line.

The first and second charging units provide a driving voltage for the driving transistor under the control of the control unit, the driving voltage is equal to a sum of the threshold voltage of the driving transistor and the data voltage.

The driving transistor is used for driving the light emitting device to emit light.

The data line provides a data voltage Vdata. One of the first power supply terminal and the second power supply terminal provides an operating voltage VDD, while the other provides a reference voltage VSS. Specifically, if the first power supply terminal provides the reference voltage VSS, then the second power supply terminal provides the operating voltage VDD higher than the reference voltage VSS; if the second power supply terminal provides the reference voltage VSS, then the first power supply terminal provides the operating voltage VDD higher than the reference voltage VSS. VDD may be a high level, and the reference voltage VSS may be a low level. The data voltage Vdata, the operating voltage VDD and the reference voltage VSS satisfy the relationship VSS<Vdata<VDD.

According to the first embodiment of the present invention, the first and second charging units are charged by the control unit respectively, such that the voltage across the first charging unit is Vth which is the threshold voltage of the driving transistor, the voltage across the second charging unit is Vdata, the sum of the voltage across the first and second charging units is Vdata+Vth. When the first and second charging units supply a voltage to the driving transistor, the gate-source voltage Vgs of the driving transistor is the sum of the voltages across the first and second charging units, i.e. Vgs=Vdata+Vth. Since the driving transistor can provide a driving current proportional to a square of the difference between the gate-source voltage and the threshold voltage, that is, $I=K*(Vgs-Vth)^2$, and Vgs=Vdata+Vth, therefore $I=K*Vdata^2$. The driving current I of the driving transistor in a saturation state is independent of the threshold voltage Vth, such that the threshold voltage Vth does not affect the current flowing through the light emitting device, thus the conformity of the driving current I can be ensured, and the uniformity in luminance of the AMOLED is better.

Optionally, in the pixel driving circuit of the first embodiment, the first gate line and the second gate line are two adjacent gate lines to be enabled sequentially, and the first gate line leads the second gate line.

Further, the first control line and the first gate line are enabled simultaneously, and the first control line keeps enabled until the second gate line is disabled. The second control line is disabled within the ON period of the first gate line, and is enabled when the first control line is disabled.

Note that the driving transistor in the present invention can be of either enhancement type or depletion type. Since the drain of the driving transistor is connected to the first power supply terminal which provides the operating voltage VDD or the reference voltage VSS, the source-drain voltage Vsd of the driving transistor is not zero during discharging of the first charging unit. Thus, no matter the threshold voltage Vth of the driving transistor is positive or negative, the first charging unit can discharge through the driving transistor until the driving transistor changes from ON state into a sub-threshold OFF state, such that the voltage across the first charging unit is Vth.

Preferably, the drive transistor is of depletion type. Further preferably, the driving transistor is an oxide thin film transistor using an oxide semiconductor layer as an active layer.

In the pixel driving circuit according to the first embodiment of the present invention, by providing two storage capacitors and improving the pre-charging manner, the gate of the driving transistor is provided with the data voltage lower than the operating voltage. In the reading stage, the driving transistor changes from ON state into a sub-threshold OFF state before the source-drain voltage of the driving transistor becomes zero. The threshold voltage is stored into the storage capacitors, thus the threshold voltage compensation is implemented, while the driving transistor in the pixel driving circuit according to the first embodiment of the present invention may be of any type.

Second Embodiment

Figure 5:
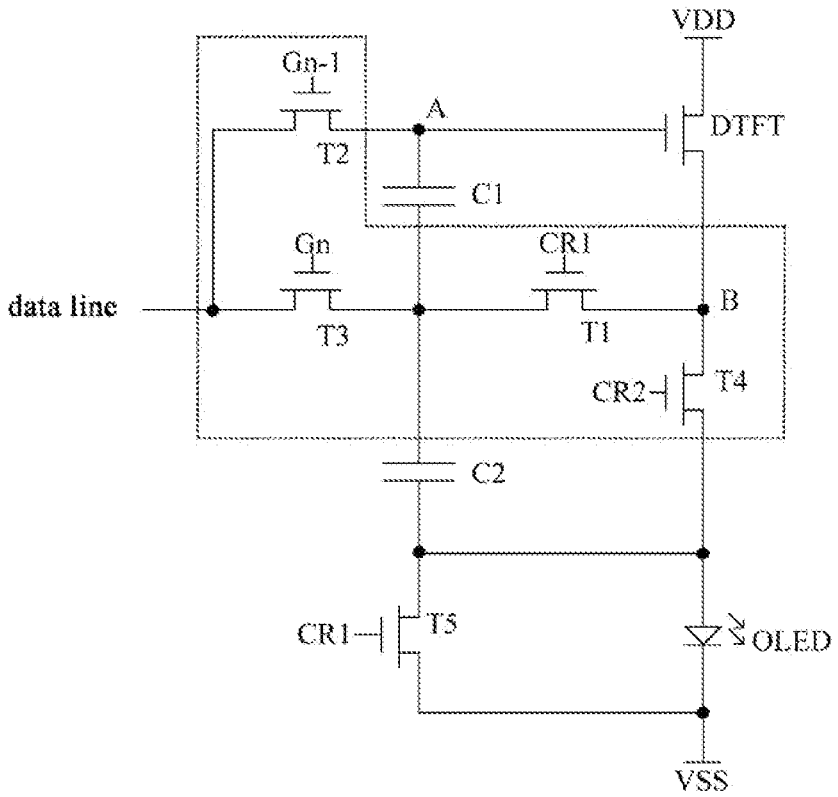
FIG. 5 is a schematic structural view of a pixel driving circuit according to the second embodiment of the present invention.

FIG. 5 is a schematic structural view of a pixel driving circuit according to the second embodiment of the present invention. As shown in FIG. 5, a control electrode of the first switch T1 is connected to the first control line, a first electrode of the first switch T1 is connected with a second terminal of the first charging unit and a first terminal of the second charging unit, a second electrode of the first switch is connected with a source of the driving transistor DTFT and a first electrode of the fourth switch.

A control electrode of the second switch T2 is connected to the first gate line, a first electrode of the second switch T2 is connected with the data line, a second electrode of the second switch T2 is connected with the first terminal of the first charging unit and the gate of the driving transistor DTFT.

A control electrode of the third switch T3 is connected to the second gate line, a first electrode of the third switch T3 is connected with the data line, a second electrode of the third switch T3 is connected with the second terminal of the first charging unit, the first terminal of the second charging unit and the first electrode of the first switch T1.

A control electrode of the fourth switch T4 is connected to the second control line, a first electrode of the fourth switch T4 is connected with the source of the driving transistor DTFT, the second electrode of the fourth switch T4 is connected with the second terminal of the second charging unit and the OLED.

The difference between the present embodiment and the first embodiment is that, the circuit in the second embodiment of the present invention is a 6T2C type circuit, the light emitting device is the OLED, the first charging unit is a first capacitor C1, the second charging unit is a second capacitor C2, the control unit comprises: a first switch T1, a second switch T2, a third switch T3 and a fourth switch T4. The data line provides the data voltage Vdata, the first control line provides a first control signal CR1, the second control line provides a second control signal CR2, the first gate line and the second gate line can load scan signals, wherein the first gate line refers to the $N-1^{th}$ gate line Gn−1, the second gate line refers to the Nth gate line Gn, the gate lines Gn−1 and Gn are two adjacent gate lines, that is, after signal scanning on the gate line Gn−1 is finished, the scan signal is loaded on the gate line Gn to perform scanning, wherein N is equal to or larger than 2.

Optionally, the pixel driving circuit further comprises a fifth switch T5, a control electrode of the fifth switch T5 is connected to the first control line, a first electrode of the fifth switch T5 is connected with the second electrode of the fourth switch T4 and a first electrode of OLED, the second electrode of the fifth switch T5 is connected with the second electrode of OLED and the second power supply terminal. The first and second electrodes of the fifth transistor T5 are connected to two terminals of the OLED for shorting the OLED when improper driving current is generated by the driving transistor DTFT, so as to prevent the OLED from emitting light with improper driving current which results in improper luminance and display error. When the driving transistor DTFT generates proper driving current, the fifth switch T5 connects the OLED and the driving transistor DTFT, such that the OLED emits light with the proper driving current, and normal display may be ensured.

In the present embodiment, the first power supply terminal provides the operating voltage VDD, the second power supply terminal provides the reference voltage VSS. The first electrode of the light emitting device is a positive electrode, and the second electrode is a negative electrode.

Furthermore, the driving transistor DTFT, the first switch T1, the second switch T2, the third switch T3, the fourth switch T4 and the fifth switch T5 are all N type TFTs which are turned on by high level signal and turned off by low level signal.

Each of the first switch T1, the second switch T2, the third switch T3, the fourth switch T4 and the fifth switch T5 has a control electrode, a first electrode and a second electrode, the first electrode and the second electrode have the same structure. When the switches are TFTs, the control electrode is the gate, one of the first electrode and the second electrode which emits carrier is the source, and the other one receiving carrier is the drain. In practice, depending on the position and function of the switch in the circuit and its channel type, the source may be the first electrode of the switch, and the drain may be the second electrode correspondingly; or, the drain may be the first electrode of the switch, and the source may be the second electrode correspondingly.

Figure 6:
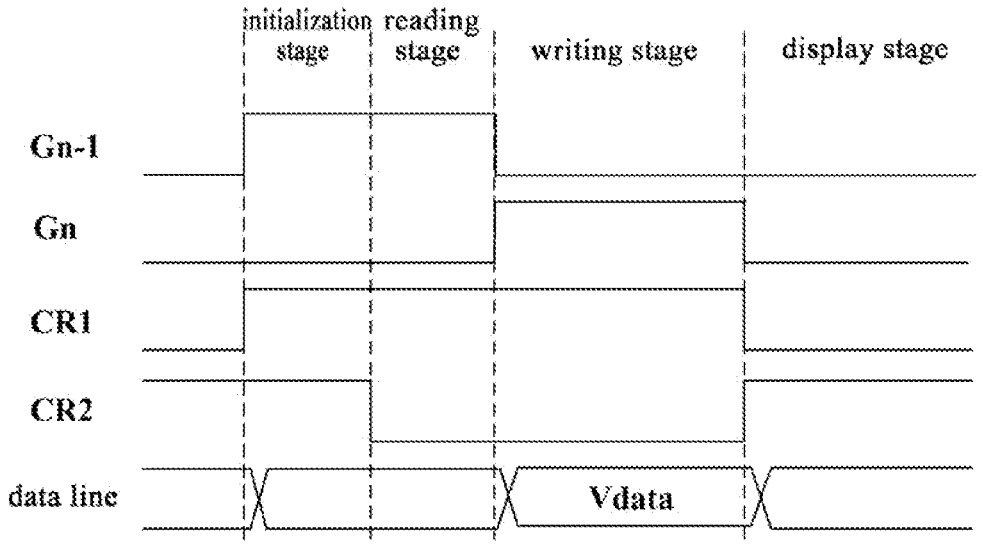
FIG. 6 is a working time sequence of the circuit shown in FIG. 5.
Figure 7:
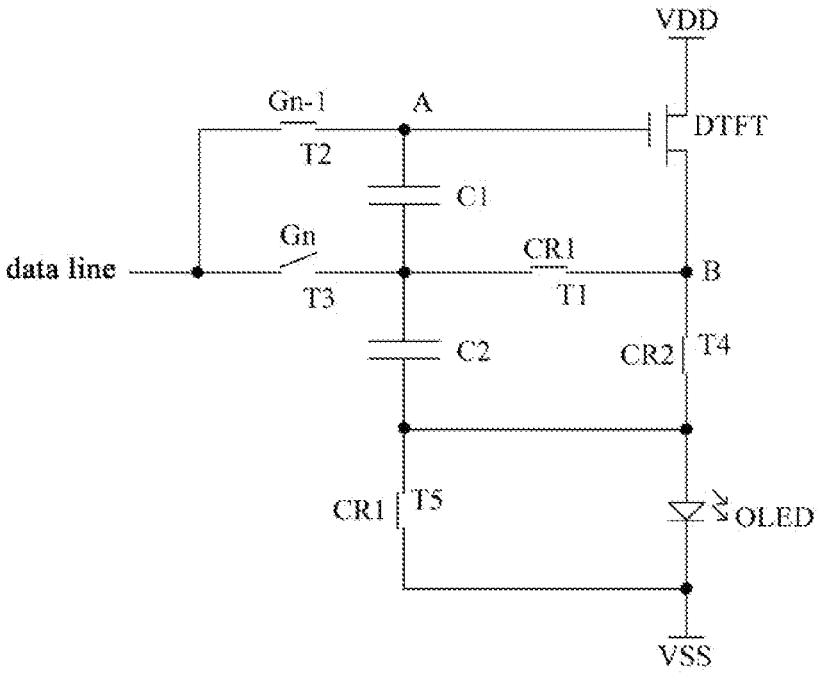
FIG. 7 is an equivalent circuit of the circuit shown in FIG. 5 in an initialization stage.
Figure 8:
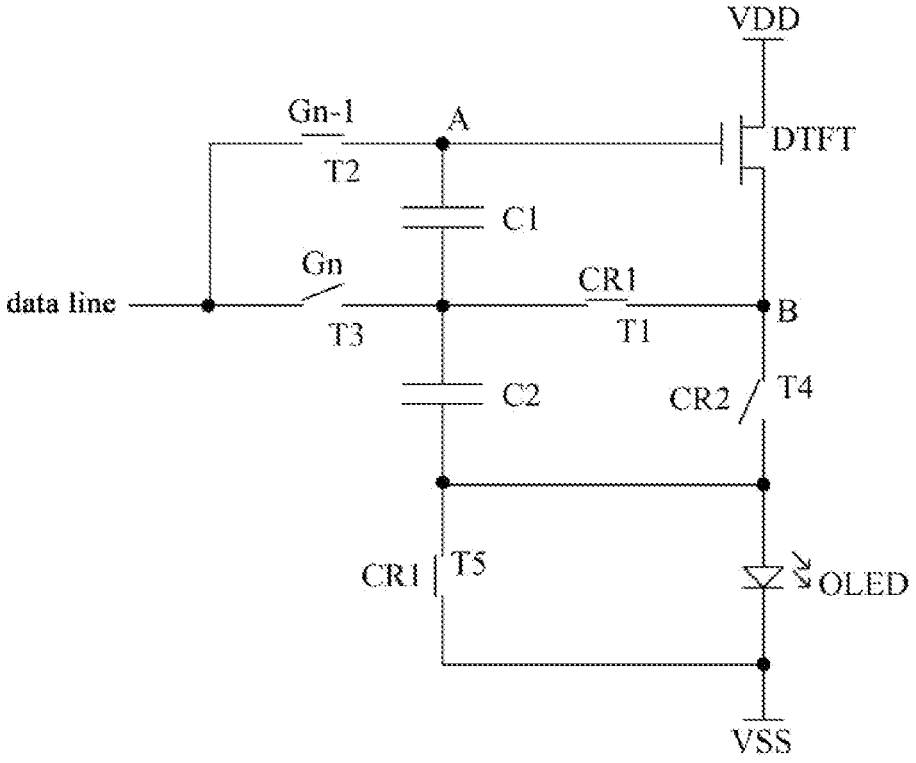
FIG. 8 is an equivalent circuit of the circuit shown in FIG. 5 in a reading stage.
Figure 9:
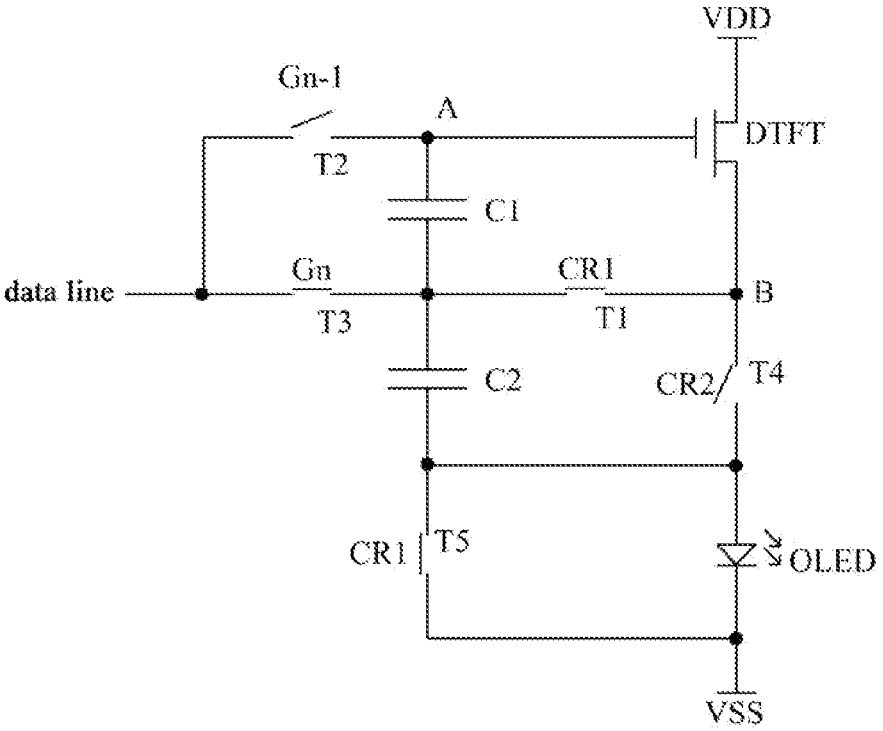
FIG. 9 is an equivalent circuit of the circuit shown in FIG. 5 in a writing stage.
Figure 10:
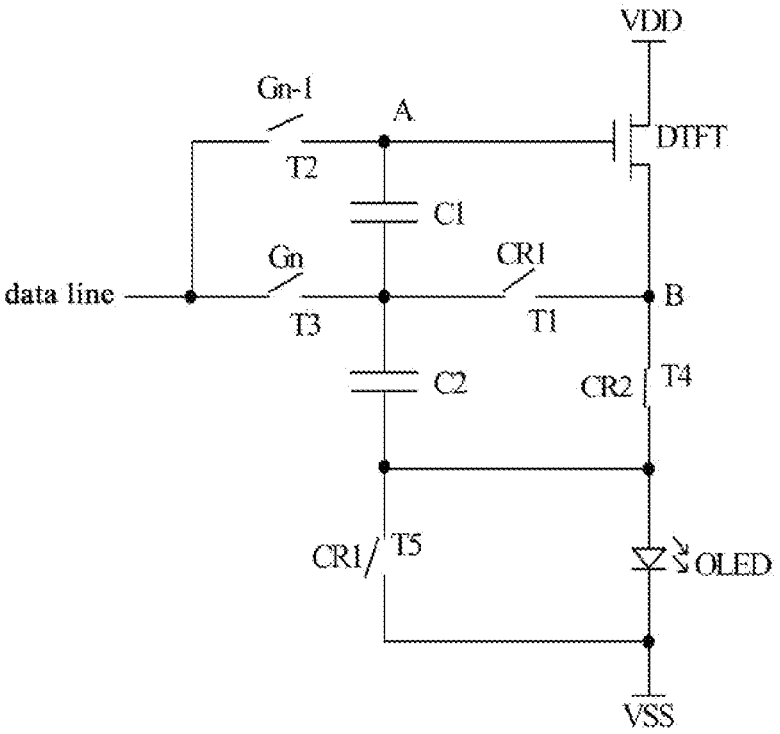
FIG. 10 is an equivalent circuit of the circuit shown in FIG. 5 in a display stage.

The working flow of the pixel driving circuit according to the second embodiment of the present invention may be divided into an initialization stage, a reading stage, a writing stage and a display stage. FIG. 6 is a working time sequence of the circuit shown in FIG. 5; FIG. 7 is an equivalent circuit of the circuit shown in FIG. 5 in the initialization stage; FIG. 8 is an equivalent circuit of the circuit shown in FIG. 5 in the reading stage; FIG. 9 is an equivalent circuit of the circuit shown in FIG. 5 in the writing stage; FIG. 10 is an equivalent circuit of the circuit shown in FIG. 5 in the display stage. Hereinafter, the working flow of the pixel driving circuit according to the second embodiment of the present invention will be described in combination with FIGS. 6 to 9.

In the initialization stage, the gate line Gn−1 has a high level, the gate line Gn has a low level, the first control signal CR1 has a high level, and the second control signal CR2 has a high level.

As shown in FIG. 7, the first switch T1, the second switch T2, the fourth switch T4 and the fifth switch T5 are turned on, the third switch T3 is turned off. The data voltage Vdata is written to the first capacitor C1 through the second switch T2, such that Va=Vdata, Vb=VSS, Vg=Vdata, and Vs=VSS, wherein Va is the voltage at node A, Vb is the voltage at node B, Vg is the gate voltage of the driving transistor DTFT, and Vs is the source voltage of the driving transistor DTFT.

In the reading stage, the gate line Gn−1 has a high level, the gate line Gn has a low level, the first control signal CR1 has a high level, and the second control signal CR2 has a low level.

As shown in FIG. 8, the first switch T1, the second switch T2 and the fifth switch T5 are turned on, the third switch T3 and the fourth switch T4 are turned off. The first capacitor C1 discharges through the driving transistor DTFT into a sub-threshold saturation cut-off state, i.e., Vgs=Vth, Vgs is the gate-source voltage of the driving transistor DTFT. Since the gate of the driving transistor DTFT is connected to the data line, thus Vg=Vdata, and Vs=Vdata-Vth. At this time Va=Vdata, Vb=Vdata-Vth, and the voltage across the first capacitor C1 is Vth.

The first capacitor C1 is charged in the reading stage, such that the voltage across the first capacitor C1 is Vth.

In the writing stage, the gate line Gn−1 has a low level, the gate line Gn has a high level, the first control signal CR1 has a high level, and the second control signal CR2 has a low level.

As shown in FIG. 9, the first switch T1, the second switch T3 and the fifth switch T5 are turned on, the third switch T2 and the fourth switch T4 are turned off. The voltage across the first capacitor C1 is kept at Vth, node B is connected with the data line such that the voltage at node B abruptly becomes Vb=Vdata, the voltage at node A abruptly becomes Va=Vdata+Vth, therefore Vg=Vdata+Vth, Vs=Vdata. Meanwhile, the data voltage Vdata is written to the second capacitor C2 through the third switch T3, such that the voltage across the second capacitor C2 is Vdata.

The second capacitor C2 is charged in the writing stage, such that the voltage across the second capacitor C2 is Vdata.

In the display stage, the gate line Gn−1 has a low level, the gate line Gn has a low level, the first control signal CR1 has a low level, and the second control signal CR2 has a high level.

As shown in FIG. 10, the fourth switch T4 are turned on, the first switch T1, the second switch T2, the third switch T3 and the fifth switch T5 are turned off. At this time the voltage across the first capacitor C1 is Vth, the voltage across the second capacitor C2 is Vdata. The first and second capacitors C1 and C2 supply a voltage to the driving transistor DTFT, thus the gate-source voltage of the driving transistor DTFT is the series voltage of the first and second capacitors C1 and C2, i.e. Vgs=Vdata+Vth, Vgs is the gate-source voltage of the driving transistor DTFT. The driving transistor DTFT drives the OLED to emit light, since the driving current $I=K*(Vgs-Vth)^2$, and Vgs=Vdata+Vth, therefore $I=K*(Vdata+Vth-Vth)^2=K*Vdata^2$. According to the pixel driving circuit provided by the second embodiment of the present invention, the driving current I of the driving transistor DTFT in a saturation state is independent of its threshold voltage Vth, such that the threshold voltage Vth of the driving transistor DTFT does not affect the current flowing through the light emitting device, thus the conformity of the driving current I can be ensured, and the uniformity in luminance of the AMOLED can be better.

Note that the driving transistor in the present invention can be of either enhancement type or depletion type. Since the drain of the driving transistor is connected to the first power supply terminal which provides the operating voltage VDD, the source-drain voltage Vsd of the driving transistor DTFT is not zero during discharging of the first capacitor C1. Thus, no matter the threshold voltage Vth of the driving transistor DTFT is positive or negative, the first capacitor C1 can discharge through the driving transistor DTFT until the driving transistor DTFT changes into a sub-threshold ON state. At this time the voltage across the first capacitor C1 is Vth.

In practice, the pixel driving circuit according to the present embodiment may be applied to the polysilicon thin film transistor and other type of transistors.

In the pixel driving circuit according to the second embodiment of the present invention, by providing two storage capacitors and improving the pre-charging manner, the gate of the driving transistor is provided with the data voltage lower than the operating voltage. During discharging through the driving transistor, the driving transistor changes from ON state into a sub-threshold OFF state before the source-drain voltage of the driving transistor becomes zero. The threshold voltage is stored into the first capacitor, thus threshold voltage compensation is implemented, while the driving transistor in the pixel driving circuit according to the second embodiment of the present invention may be of any type.

Third Embodiment

Figure 11:
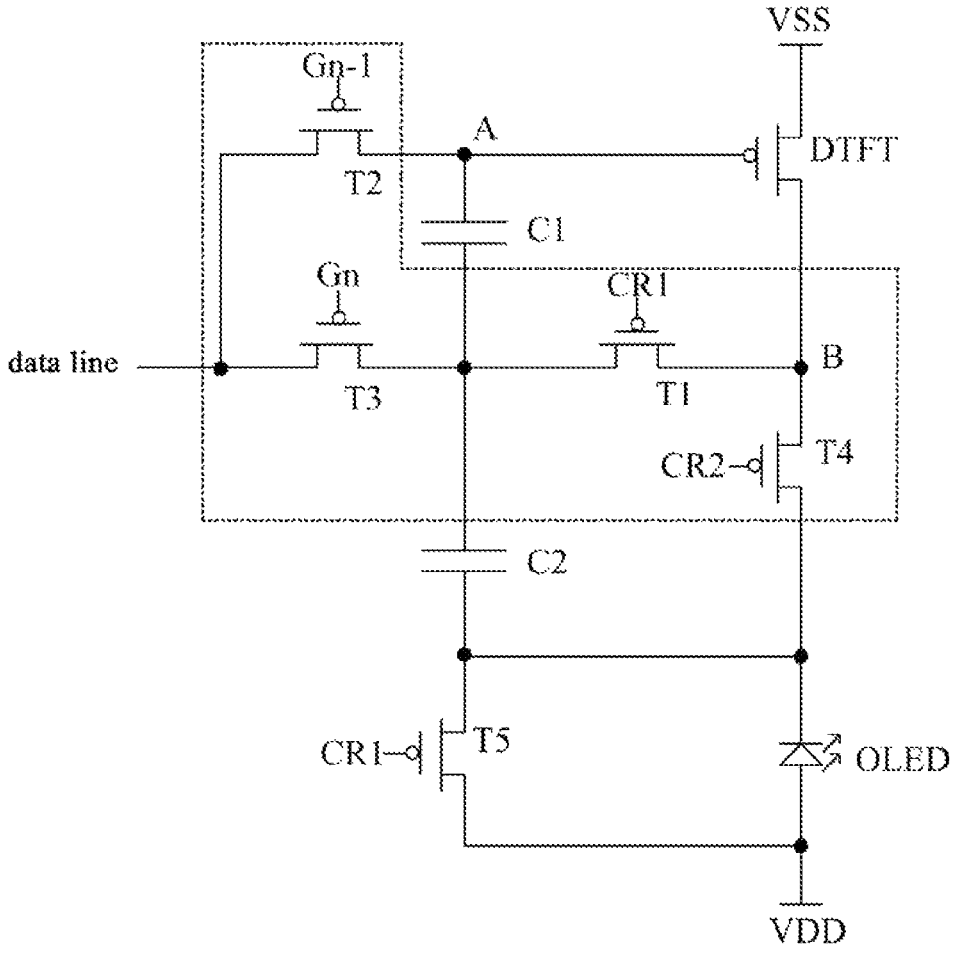
FIG. 11 is a schematic structural view of a pixel driving circuit according to the third embodiment of the present invention.

FIG. 11 is a schematic structural view of a pixel driving circuit according to the third embodiment of the present invention. As shown in FIG. 11, the difference between pixel driving circuit of the present embodiment and the second embodiment is that, the first power supply terminal provides the reference voltage, the negative electrode of the light emitting device is connected with the second electrode of the fourth switch, the positive electrode of the light emitting device is connected with the second power supply terminal. The control electrode of the fifth switch T5 is connected to the first control line, the first electrode of the fifth switch T5 is connected with the second electrode of the fourth switch T4 and the negative electrode of the light emitting device, the second electrode of the fifth switch T5 is connected with the positive electrode of the light emitting device and the second power supply terminal. The driving transistor, the first switch T1, the second switch T2, the third switch T3, the fourth switch T4 and the fifth switch T5 are P type TFTs which are turned on by a low level signal and turned off by a high level signal.

The operating sequence of the switches in the pixel driving circuit according to the third embodiment of the present invention and the working flow of the entire circuit are similar to those in the second embodiment, thus detailed description thereof is omitted here.

In the pixel driving circuit according to the third embodiment of the present invention, by providing two storage capacitors and improving the pre-charging manner, the gate of the driving transistor is provided with the data voltage lower than the operating voltage. During discharging through the driving transistor, the driving transistor changes from ON state into a sub-threshold OFF state before the source-drain voltage of the driving transistor becomes zero. The threshold voltage is stored into the first capacitor, thus threshold voltage compensation is implemented, while the driving transistor in the pixel driving circuit according to the third embodiment of the present invention may be of any type.

Fourth Embodiment

The fourth embodiment of the present invention provides a display device comprising an adjustment unit, a data line driving unit, a gate line driving unit, a data line, gate lines, the first control line, the second control line and a plurality of pixel driving circuits. The adjustment unit is used for adjusting the first and second control lines, the data line driving unit is used for driving the date line, the gate line driving unit is used for driving the gate lines in sequence. The pixel driving circuit of the present embodiment may be the pixel driving circuit according to the first, second or third embodiment, detailed description thereof is omitted here. Each pixel driving circuit is connected with two gate lines among the gate lines.

The pixel driving circuit according to the fourth embodiment of the present invention comprises a pixel driving circuit. In the pixel driving circuit, by providing two storage capacitors and improving the pre-charging manner, the gate of the driving transistor is provided with the data voltage lower than the operating voltage. During discharging through the driving transistor, the driving transistor changes from ON state into a sub-threshold OFF state before the source-drain voltage of the driving transistor becomes zero. The threshold voltage is stored into the first capacitor, thus threshold voltage compensation is implemented, while the driving transistor in the pixel driving circuit according to the fourth embodiment of the present invention may be of any type.

Fifth Embodiment

Figure 12:
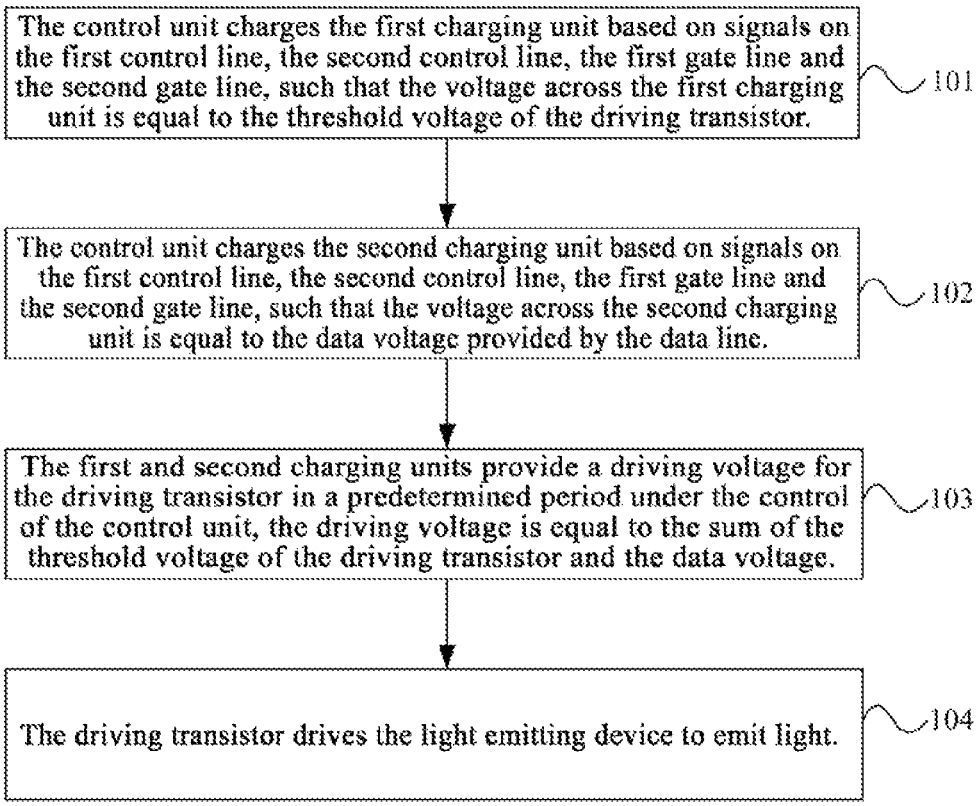
FIG. 12 is a flowchart of the pixel driving method provided by the fifth embodiment of the present invention.

FIG. 12 is a flowchart of the pixel driving method provided by the fifth embodiment of the present invention. The pixel driving method is based on a pixel driving circuit comprising: a light emitting device, a driving transistor, a control unit, a first charging unit, a second charging unit, a first power supply terminal and a second power supply terminal; the control unit is connected with the data line, a first control line, a second control line, a first gate line and a second gate line; the first charging unit and the second charging unit are both connected with the control unit, a gate of the driving transistor is connected with the first charging unit, a drain of the driving transistor is connected with the first power supply terminal, a source of the driving transistor is connected with the control unit, a first electrode of the light emitting device is connected with the control unit and the second charging unit, and a second electrode of the light emitting device is connected with the second power supply. As shown in FIG. 12, the pixel driving method comprises the following steps:

Step 101: the control unit charges the first charging unit based on signals on the first control line, the second control line, the first gate line and the second gate line, such that the voltage across the first charging unit is equal to the threshold voltage of the driving transistor;

Step 102: the control unit charges the second charging unit based on signals on the first control line, the second control line, the first gate line and the second gate line, such that the voltage across the second charging unit is equal to the data voltage provided by the data line;

Step 103: the first and second charging units provide a driving voltage for the driving transistor in a predetermined period under the control of the control unit, the driving voltage is equal to the sum of the threshold voltage of the driving transistor and the data voltage;

Step 104: the driving transistor drives the light emitting device to emit light.

In the pixel driving method according to the fifth embodiment of the present invention, by providing two storage capacitors and improving the pre-charging manner, the gate of the driving transistor is provided with the data voltage lower than the operating voltage. During discharging through the driving transistor, the driving transistor changes from ON state into a sub-threshold OFF state before the source-drain voltage of the driving transistor becomes zero. The threshold voltage is stored into the storage capacitor, thus threshold voltage compensation is implemented, while the driving transistor in the pixel driving method according to the fifth embodiment of the present invention may be of any type.

It should be understood that, the above examples are only specific embodiments illustrative of the principle of the present invention, but the present invention is not limited thereto. Any change or improvement that is readily conceivable to those skilled in the art without departing from the spirit and substance of the present invention should be encompassed by the protection scope of the present invention.

What is claimed is:

1. A pixel driving circuit comprising: a light emitting device, a driving transistor, a control unit, a first charging unit, a second charging unit, a first power supply terminal and a second power supply terminal; the control unit is connected with a data line, a first control line, a second control line, a first gate line and a second gate line; the first charging unit and the second charging unit are both connected with the control unit, a gate of the driving transistor is connected with the first charging unit, a drain of the driving transistor is connected with the first power supply terminal, a source of the driving transistor is connected with the control unit; a first electrode of the light emitting device is connected with the control unit and the second charging unit, and a second electrode of the light emitting device is connected with the second power supply; wherein the control unit is used for charging the first charging unit and the second charging unit in turn based on signals on the first control line, the second control line, the first gate line and the second gate line, such that the voltage across the first charging unit is equal to the threshold voltage of the driving transistor and the voltage across the second charging unit is equal to the data voltage provided by the data line;

the first charging unit and the second charging unit are used for providing a driving voltage for the driving transistor under the control of the control unit, the driving voltage is equal to the sum of the threshold voltage of the driving transistor and the data voltage; and the driving transistor is used for driving the light emitting device to emit light.

2. The pixel driving circuit according to claim 1, wherein the control unit comprises: a first switch, a second switch, a third switch and a fourth switch;

a control electrode of the first switch is connected to the first control line, a first electrode of the first switch is connected with a second terminal of the first charging unit and a first terminal of the second charging unit, a second electrode of the first switch is connected with a source of the driving transistor and a first electrode of the fourth switch;

a control electrode of the second switch is connected to the first gate line, a first electrode of the second switch is connected with the data line, a second electrode of the second switch is connected with the first terminal of the first charging unit and the gate of the driving transistor;

a control electrode of the third switch is connected to the second gate line, a first electrode of the third switch is connected with the data line, a second electrode of the third switch is connected with the second terminal of the first charging unit, the first terminal of the second charging unit and the first electrode of the first switch; and a control electrode of the fourth switch is connected to the second control line, a first electrode of the fourth switch is connected with the source of the driving transistor, a second electrode of the fourth switch is connected with the second terminal of the second charging unit and a first electrode of the light emitting device.

3. The pixel driving circuit according to claim 2, further comprising a fifth switch, a control electrode of the fifth switch is connected to the first control line, a first electrode of the fifth switch is connected with the second electrode of the fourth switch and the first electrode of the light emitting device, a second electrode of the fifth switch is connected with the second electrode of the light emitting device and the second power supply terminal.

4. The pixel driving circuit according to claim 3, wherein the first power supply terminal provides an operating voltage, the second power supply terminal provides a reference voltage; the first electrode of the light emitting device is a positive electrode, and the second electrode of the light emitting device is a negative electrode.

5. The pixel driving circuit according to claim 4, wherein the driving transistor, the first switch, the second switch, the third switch, the fourth switch and the fifth switch are N type thin film transistors.

6. The pixel driving circuit according to claim 3, wherein the first power supply terminal provides a reference voltage, the second power supply terminal provides an operating voltage; the first electrode of the light emitting device is a negative electrode, and the second electrode of the light emitting device is a positive electrode.

7. The pixel driving circuit according to claim 6, wherein the driving transistor, the first switch, the second switch, the third switch, the fourth switch and the fifth switch are P type thin film transistors.

8. The pixel driving circuit according to claim 2, wherein the first gate line and the second gate line are two adjacent gate lines to be enabled sequentially, and the first gate line leads the second gate line.

9. The pixel driving circuit according to claim 8, wherein the first control line and the first gate line are enabled simultaneously, and the first control line keep enabled until the second gate line is disabled; the second control line is disabled within the ON period of the first gate line, and is enabled when the first control line is disabled.

10. A display device comprising an adjustment unit, a data line driving unit, a gate line driving unit, a data line, gate lines, the first control line, the second control line and a plurality of pixel driving circuit; the adjustment unit is used for adjusting the first and second control lines, the data line driving unit is used for driving the date line, the gate line driving unit is used for driving the gate lines in sequence;

said pixel driving circuit is a pixel driving circuit comprising: a light emitting device, a driving transistor, a control unit, a first charging unit, a second charging unit, a first power supply terminal and a second power supply terminal; the control unit is connected with a data line, a first control line, a second control line, a first gate line and a second gate line; the first charging unit and the second charging unit are both connected with the control unit, a gate of the driving transistor is connected with the first charging unit, a drain of the driving transistor is connected with the first power supply terminal, a source of the driving transistor is connected with the control unit; a first electrode of the light emitting device is connected with the control unit and the second charging unit, and a second electrode of the light emitting device is connected with the second power supply; wherein the control unit is used for charging the first charging unit and the second charging unit in turn based on signals on the first control line, the second control line, the first gate line and the second gate line, such that the voltage across the first charging unit is equal to the threshold voltage of the driving transistor and the voltage across the second charging unit is equal to the data voltage provided by the data line;

the first charging unit and the second charging unit are used for providing a driving voltage for the driving transistor under the control of the control unit, the driving voltage is equal to the sum of the threshold voltage of the driving transistor and the data voltage; and the driving transistor is used for driving the light emitting device to emit light, each pixel driving circuit is connected with two adjacent gate lines among the plurality of gate lines.

11. A pixel driving method based on a pixel driving circuit comprising a light emitting device, a driving transistor, a control unit, a first charging unit, a second charging unit, a first power supply terminal and a second power supply terminal; the control unit is connected with a data line, a first control line, a second control line, a first gate line and a second gate line; the first charging unit and the second charging unit are both connected with the control unit, a gate of the driving transistor is connected with the first charging unit, a drain of the driving transistor is connected with the first power supply terminal, a source of the driving transistor is connected with the control unit, a first electrode of the light emitting device is connected with the control unit and the second charging unit, and a second electrode of the light emitting device is connected with the second power supply; the pixel driving method comprises:

the control unit charges the first charging unit based on signals on the first control line, the second control line, the first gate line and the second gate line, such that the voltage across the first charging unit is equal to the threshold voltage of the driving transistor;

the control unit charges the second charging unit based on signals on the first control line, the second control line, the first gate line and the second gate line, such that the voltage across the second charging unit is equal to the data voltage provided by the data line;

the first and second charging units provide a driving voltage for the driving transistor in a predetermined period under the control of the control unit, the driving voltage is equal to the sum of the threshold voltage of the driving transistor and the data voltage; and the driving transistor drives the light emitting device to emit light.

12. The pixel driving method according to claim 11, wherein the operation of charging the first charging unit comprises an initialization stage and a reading stage, wherein in the initialization stage, the first gate line has a high level, the second gate line has a low level, the first control line has a high level, and the second control line has a high level;

in the reading stage, the first gate line has a high level, the second gate line has a low level, the first control line has a high level, and the second control line has a low level;

the operation of charging the first charging unit comprises a writing stage, in the writing stage, the first gate line has a low level, the second gate line has a high level, the first control line has a high level, and the second control line has a low level;

the operation of driving the light emitting device to emit light comprises a display stage, in the display stage, the first gate line has a low level, the second gate line has a low level, the first control line has a low level, and the second control line has a high level.

* * * * *